US005881897A

United States Patent [19]

Rojek

[11] Patent Number: 5,881,897

[45] Date of Patent: Mar. 16, 1999

[54] VACUUM-CLOSURE CANS HAVING NON-NAILED, EASY-OPENING METALLIC LIDS

[75] Inventor: Arnaldo Rojek, Sao Paulo, Brazil

[73] Assignee: Metalgrafica Rojek Ltda, Brazil

[21] Appl. No.: 778,895

[22] Filed: Jan. 3, 1997

[30] Foreign Application Priority Data

Jan. 10, 1996 [BR] Brazil ..... 9600045

[51] Int. Cl.[6] ..... B65D 51/16

[52] U.S. Cl. ..... 220/254; 220/795; 220/806; 220/310.1; 220/364

[58] Field of Search ..... 220/231, 240, 220/254, 257, 795, 806, 601, 669, 675, 23.83, 780, 310.1, 794, 796, 364, 361; 215/262, 260, 270, 307, 310

[56] References Cited

U.S. PATENT DOCUMENTS

| | | | |
|---|---|---|---|
| 1,374,389 | 4/1921 | Reichenbach | 220/780 |
| 1,706,638 | 3/1929 | Thomas . | |
| 1,985,788 | 12/1934 | Gore-Lloyd | 215/262 |
| 2,141,184 | 12/1938 | Hothersall . | |
| 2,503,944 | 4/1950 | Frascari | 220/240 X |
| 2,670,871 | 3/1954 | Spiess, Jr. et al. | 220/240 X |
| 2,777,125 | 1/1957 | Weisse | 220/231 |
| 3,243,075 | 3/1966 | Reinke | 220/231 |
| 3,369,689 | 2/1968 | Dodge | 215/262 |
| 3,371,811 | 3/1968 | McKnight | 215/262 |
| 3,462,037 | 8/1969 | Keller | 215/262 |
| 5,275,679 | 1/1994 | Rojek . | |
| 5,439,724 | 8/1995 | Rojek . | |

FOREIGN PATENT DOCUMENTS

| | | |
|---|---|---|
| 9103896 | 2/1994 | Brazil . |
| 9203029 | 7/1995 | Brazil . |
| 9620 | 7/1908 | France . |
| 2718115 | 10/1995 | France . |

OTHER PUBLICATIONS

European Search Report for Application No. EP 97 83 0002 dated Apr. 21, 1997.

*Primary Examiner*—Stephen K. Cronin
*Assistant Examiner*—Nathan Newhouse
*Attorney, Agent, or Firm*—Webb Ziesenheim Bruening Logsdon Orkin & Hanson, P.C.

[57] ABSTRACT

A can is formed by an overall cylindrical body with a nailed bottom wall and presenting on its superior part and close to an aperture thereof a round fillet which is outwardly turned. The closure of the can is by a metallic, easy-opening lid, formed essentially by a circular panel with a short descending skirt which is provided with a narrow peripheral fillet. The lid includes a sealing gasket on its internal surface and presenting, in the middle of its panel, a circular basin-shaped depression with a central hollow which is closed by a resinous, thermoplastic, detachable seal. The present improvements provide a new configuration for the superior part of the can body, by which the referred skirt of the lid and its respective fillet are inwardly spaced in relation to the side wall of the cylindrical body of the can, in such a way to eliminate any possibility of mounting or overlapping of the peripheral fillets of adjacent cans, whenever the cans are grouped or placed side by side.

1 Claim, 4 Drawing Sheets

VACUUM-CLOSURE CANS HAVING NON-NAILED, EASY-OPENING METALLIC LIDS

BACKGROUND OF THE INVENTION

1. Field of the Invention

The present invention relates to improvements in vacuum-closure cans having non-nailed, easy-opening, metallic lids, for foodstuff packing.

2. Background Information

The can to which the present improvements relate is the object of Brazilian Patent BR No. 9203029 of Jul. 25, 1995 to the same inventor as this application. This patent essentially discloses a cylindrical body with a bottom wall normally fixed by nailing. The body includes, on its superior part and close to the top thereof, a round fillet outwardly turned that allows the can to be closed by a non-nailed, easy-opening metallic lid. The referred lid is the object of Brazilian Patent No. 9103896-0, of Feb. 1, 1994 to the same inventor. This lid essentially comprises a circular panel, presenting a descending edge or casing, provided with a narrow peripheral fillet. The lid is provided with a blocking gasket and, on the center of its panel, with a circular depression with a hollow center sealed by a resinous detachable seal.

The present invention would not be feasible without the pre-existing easy-opening lid, which has been successfully adopted in the closure of glass cups and pots. This kind of lid is used with the same practical advantages in a tinned food closure.

Both the easy-opening lid and can inventions discussed above, required great efforts and investments in research and experiments, including the creation of special equipment and new technologies to allow the manufacture of this package in high production scales.

This easy-opening can modified the traditional systems of metallic foodstuff packing closure, and distinguishes from others basically by not comprising any mechanical device for lid retention. The lid is kept closed only by atmospheric pressure. The closure is maintained by an elevated vacuum formed in the interior of the package.

These vacuum-closure cans with the non-nailed, easy-opening, metallic lids are distinguished from conventional cans by their practical and utilitarian aspects which focus not only on the manufacturers of foodstuff packings but particularly on the consumers, thanks to the safety and simplicity that they offer against accidents. Once the can is opened, it doesn't require any auxiliary device or extra effort. The lid is released by the aid of a simple extraction of the lid which is lifted with the nail edge and, subsequently removed by the user's fingers.

Some inconvenient aspects of the closure were found in practice, not only on the industrial operation lines but in storage, delivering and general manipulation of these cans. This is due to the delicate closing process which is obtained only by vacuum action and through the application of vapor spargers. A tinned product is, at this time, at a temperature higher than 194° F.

As long as the canned product temperature is very high, the vapor-sparger closing machine naturally forms only a very low vacuum in the interior of the can. This provides, at this moment, a very low level of safety for the closure.

The industrial process for such cans includes the following sequential steps: filling, vacuum-closing, sterilizing and cooling. From one step to the next, the cans are transported in rows at high velocities in order to be automatically inserted into the corresponding machines, thereby provoking collisions among such cans. During this process, the peripheral fillets on the lids lift up one over another resulting in a bunch of accidental openings of the lids due to the low vacuum. This is illustrated in FIG. 5 and results in much lost production. It is impossible for the sealing machine to provide a higher vacuum while the product in the cans are at temperatures higher than 194° F.

Such conditions cannot be modified during the closing process of the easy-opening cans mentioned above, as long as the vapor sparge as well as the canned product are above 194° F. This requires the cans to be instantaneously closed to keep the vapor sparge in the free space that is formed above the product, in order to be condensed and, thereby form the initial vacuum.

Therefore these high temperatures resulting from the closing process of this kind of package cannot be modified because, as soon as the final process takes place, a high vacuum (which is responsible to the closure safety) will result from such temperatures.

Another problem with this kind of package is that whenever the closed cans—provided with a high vacuum and ready for transport and storage—are closely arranged and placed in the pasteboard boxes, they keep their peripheral fillets (placed on the lids) intimately supported and submitted to lifting up among themselves. The action of the weight of the stacked boxes provokes the effort of one fillet against another and the vibration during transport causes accidental opening of the cans, and, thus, total loss of the product within the opened can.

SUMMARY OF THE INVENTION

The present invention solves all these inconveniences of the prior art by providing an easy-opening can with a safety design minimizing accidental opening during the production process and during the transport, storage or general manipulation of the can. With the present improvements, it is possible to keep the peripheral fillets of the lids sufficiently secluded or displaced in relation to the cylindrical body whenever the cans are closed and tightly grouped together. This allows the cans to be friction free and eliminates the undesirable mounting and superposition of the prior art fillets.

The present invention focuses on a simple modification in the shape and dimensions of the can. The present invention repositions the prior art peripheral fillet from an inappropriate and harmful position to another one that protects it from any damage to its functions, and eliminates the aforementioned inconveniences as will be demonstrated herein.

The present improvements do not interfere with any other constructive features already known in metallic can manufacturing.

BRIEF DESCRIPTION OF THE DRAWINGS

The improvements introduced into vacuum-closure cans having non-nailed, easy-opening, metallic lids for foodstuff packing, are represented by the following drawings.

DESCRIPTION OF THE PREFERRED EMBODIMENT

Figure 1:
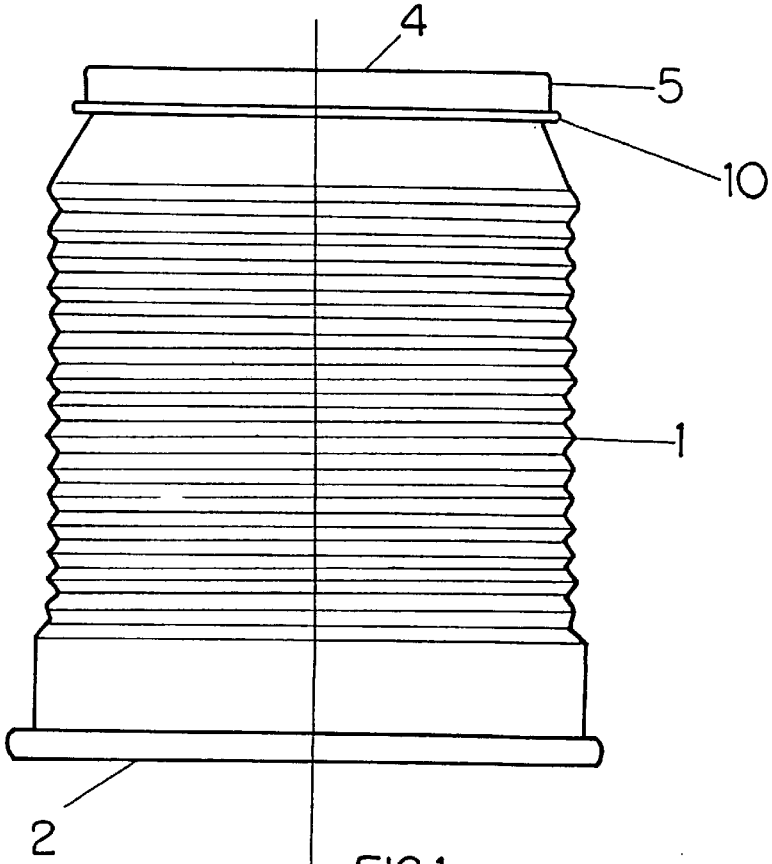
FIG. 1 is a side view of a can and its respective lid according to the present invention.
Figure 2:
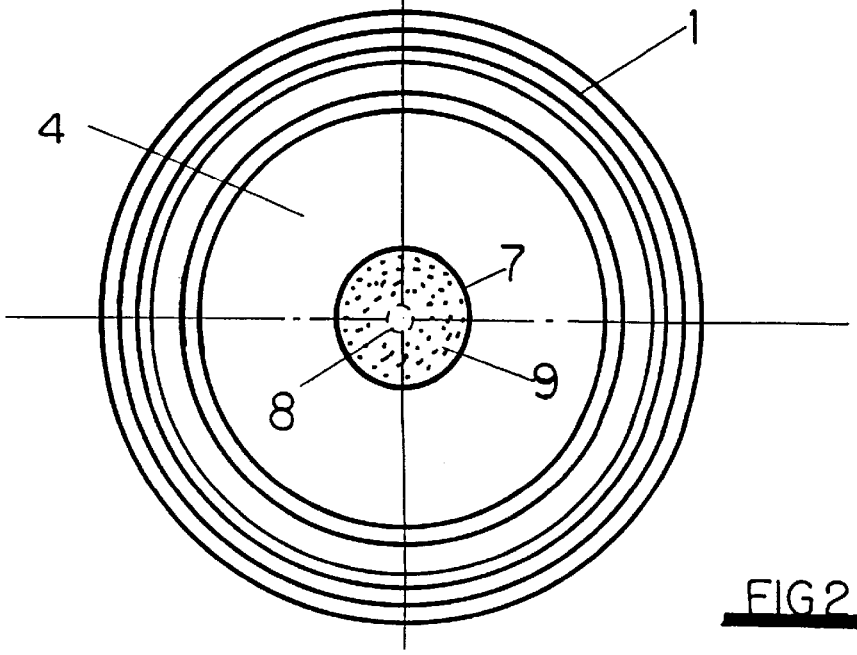
FIG. 2 is a top view of the can illustrated in FIG. 1.

The present invention, which is shown in the drawings, provides a new design to the upper part of the can body which, in its original form, is the object of Brazilian Patent BR No. 9203029-7. The can body includes an overall cylindrical body 1, a nailed bottom wall 2 and, on the superior part, close to the aperture, a round fillet 3 outwardly projected. The fillet 3 is susceptible to receiving a non-nailed, metallic, easy-opening lid formed by a circular panel 4, with a descending edge 5. The internal surface of the lid includes a sealing gasket 6 and, in the middle of the panel, a circular basin-shaped depression 7, with a central hollow 8 which is sealed by a resinous, thermoplastic, detachable sealing-wax 9. Such a lid is the object of Brazilian Patent No. 9103896-0.

This kind of lid is provided, on the lower peripheral edge of the edge 5, with a narrow round fillet 10. The fillet 10 is meant to facilitate the raising and withdrawal of the lid from its closing position to release the vacuum, which is responsible for lid retention.

Figure 5:
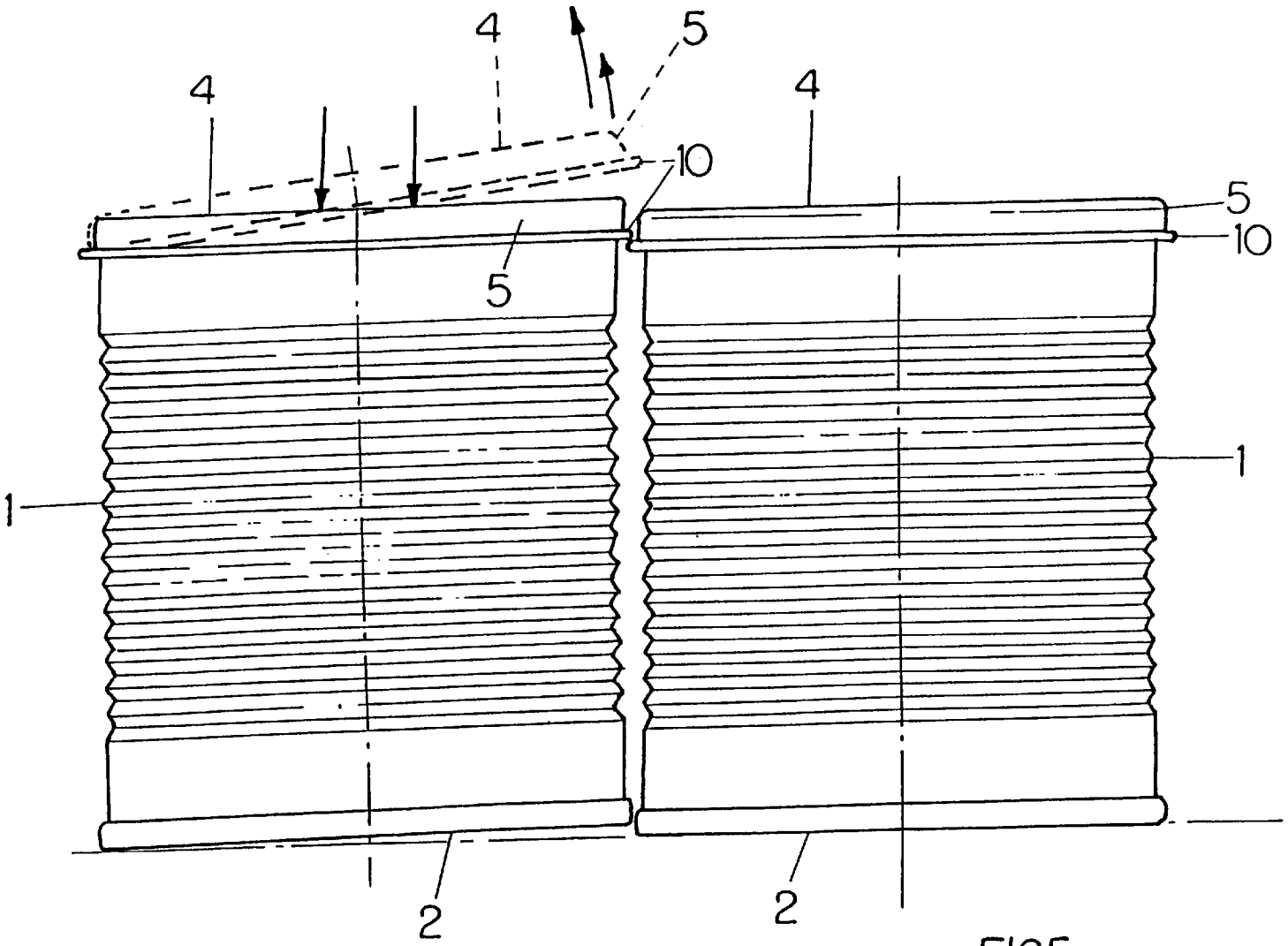
FIG. 5 is a side view showing two cans and respective lids of the prior art leaned against each other.

In the prior art cans, whenever the lid was applied or placed in the closing position—as shown in FIG. 5—the fillets 10 laterally projected outside in relation to the cylindrical body 1 of the can. Consequently, whenever the cans were arranged in groups, side by side, the fillets 10 would overlap each other due to vibrations and tremblings, which result in the accidental opening of the cans, for the reasons previously explained.

Figure 3:
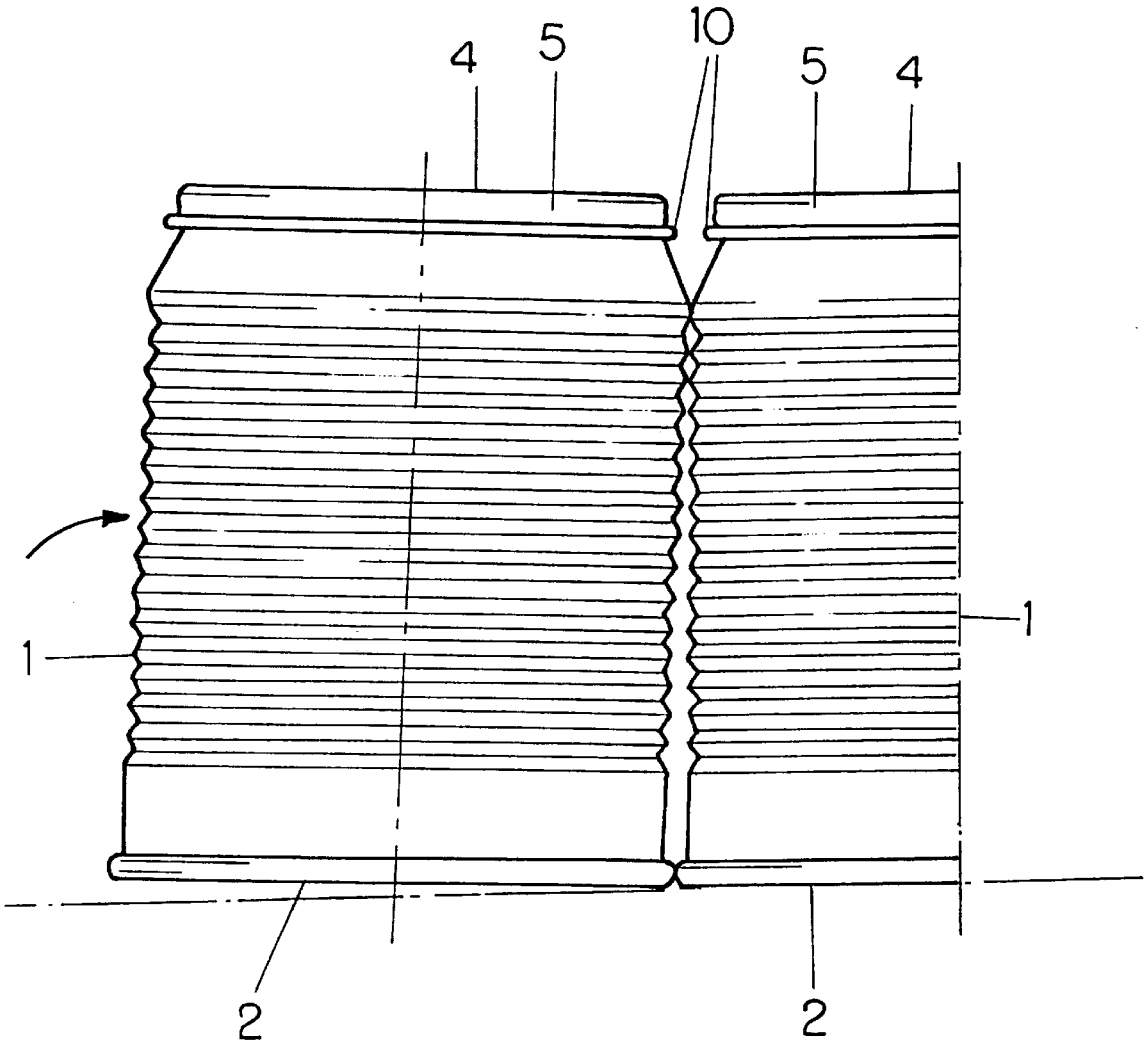
FIG. 3 is a side view of two cans according to the present invention leaned against each other.
Figure 4:
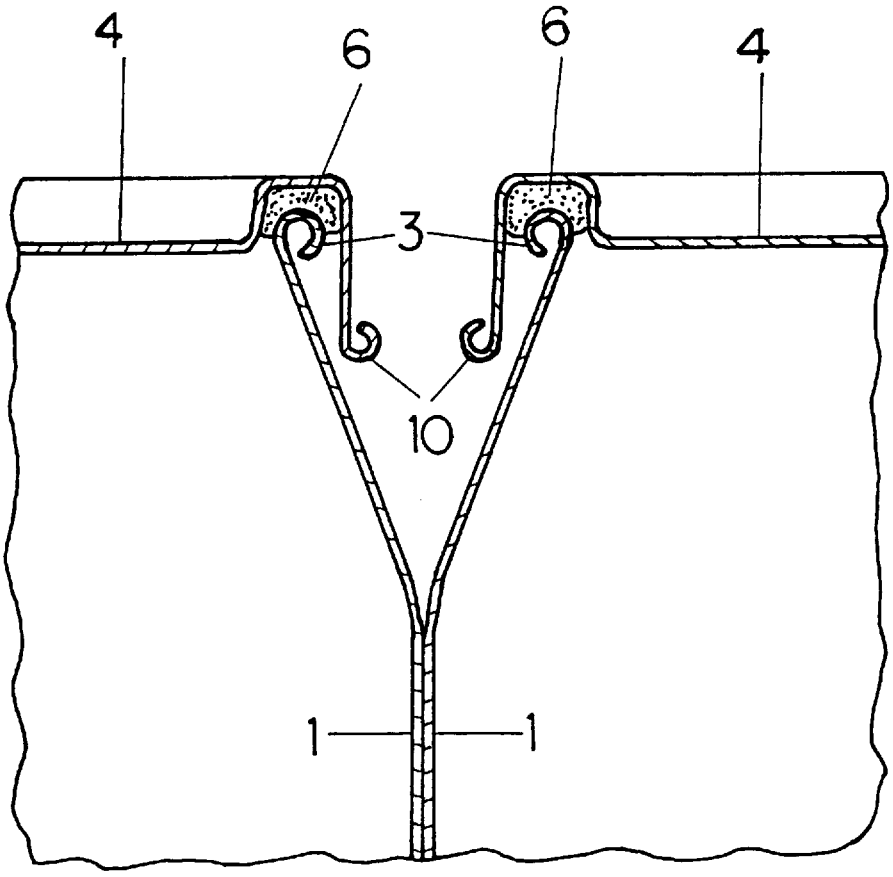
FIG. 4 is an enlarged, sectional side view of two cans of the present invention leaned against each other.

In accordance to the present improvements shown by FIGS. 1, 3 and 4, a new inwardly tapered configuration was given to the superior part of the can body. The upper part of the can is provided with sufficient taper to position the edge or skirt 5 of the lid and of its respective peripheral fillet 10 inwardly in relation to the outermost lateral wall of the cylindrical body 1 of the can as shown in FIGS. 1, 3 and 4. Therefore, whenever the cans are grouped or intimately leaned against each other, these peripheral fillets 10 are kept free of each other and are incapable of mounting or overlapping, which is responsible for the accidental opening of this kind of packing. In other words, this kind of problem is completely avoided with the present improvements.

It is important to clarify the significance of the present improvements. This kind of can, wherein closure is obtained by a metallic, non-nailed, easy-opening lid retained only by vacuum action without any other mechanical means of retention, offers lots of advantages and deserves the preference of the consumers. This is a result of the extreme easiness for opening as well as to the safety against wounds on the user's hands which is recognized as a great evolution in metallic packings. Nevertheless, the above-mentioned problems, observed during practice, have been threatening such a consumer preference. Such problems, however, have been totally solved and eliminated by the improvements that comprise the subject of the present invention.

The claims defining the present invention are as follows:

1. A vacuum-closure can having a metallic, non-nailed, easy-opening lid for foodstuff packing, wherein said can comprises:

a cylindrical body having a nailed bottom wall, a central portion with an outside diameter extending along its length and further having a superior part tapering continuously inwardly from the central portion, said cylindrical body presenting, on its superior part and close to an aperture thereof, a round fillet turned outwardly, wherein said superior part connects said fillet with the central portion of the body; and a metallic, easy-opening lid received on said fillet of said cylindrical body, said lid including a circular panel with a short descending skirt having a peripheral fillet and having on its internal surface a sealing gasket, and in the middle of said panel a circular basin-shaped depression with a central hollow which is closed by a resinous, detachable seal, wherein said skirt of said lid, said peripheral fillet of said skirt and said superior part are inwardly spaced from the outside diameter of the central portion of said cylindrical body.

* * * * *